US005806604A

United States Patent [19]

Sanders

[11] Patent Number: 5,806,604

[45] Date of Patent: Sep. 15, 1998

[54] APPARATUS FOR DEPTH MONITORING

[75] Inventor: Trevor George Sanders, Berks, England

[73] Assignee: Thames Water Utilities Limited, England

[21] Appl. No.: 766,869

[22] Filed: Dec. 13, 1996

[30] Foreign Application Priority Data

Dec. 15, 1995 [GB] United Kingdom ..... 9525689

[51] Int. Cl.[6] ..... E02F 3/76

[52] U.S. Cl. ..... 172/4.5; 37/DIG. 20

[58] Field of Search ..... 37/348; 172/2, 172/4, 4.5, 7, 12; 364/24.07; 356/4, 5, 152

[56] References Cited

U.S. PATENT DOCUMENTS 3,494,426 2/1970 Studebaker ..... 172/4.5

3,887,012 6/1975 Scholl et al. ..... 172/4.5

4,299,290 11/1981 Nunes, Jr. ..... 172/4.5

4,807,131 2/1989 Clegg ..... 172/4.5 X

*Primary Examiner*—Terry Lee Melius

*Assistant Examiner*—Robert Pezzuto

*Attorney, Agent, or Firm*—Blakely Sokoloff Taylor & Zafman

[57] ABSTRACT

The invention relates to apparatus for monitoring the depth of a layer of a filter media such as sand in a filter such as a slow sand filter, comprising a leveller, in the embodiment a box leveller with a trailing smoothing device, wheel or roller, adapted to level the surface of the layer of sand and a laser device mounted on a mount which is movable substantially vertically and has a calibration means in the form of a visual calibration scale whereby to determine depth of filter media.

10 Claims, 2 Drawing Sheets

APPARATUS FOR DEPTH MONITORING

The invention relates to apparatus for depth monitoring, particularly for monitoring the depth of a layer of filter media in a filter, such as the depth of sand above a layer of activated granular carbon in a slow sand filter in a water treatment works.

Box levellers, also know as box scrapers, are often used for this purpose. They are usually towed behind a tractor unit to effect levelling, for example sand but it is often difficult to assess the position of the sand surface during a levelling operation, relative to a given action point.

It is an object of the invention to seek to mitigate these disadvantages.

According to the invention there is provided apparatus for monitoring the depth of a layer of filter media in a filter, comprising a leveller adapted to level the surface of the layer and a laser device mounted on a mount which is movable substantially vertically and has a calibration means whereby to determine depth of the filter media.

The mount may comprise an elongate member and the calibration means may increase from a zero in two directions along the length of the elongate member.

The elongate member may comprise a telescopic member.

The member may be carried by a fixed support element.

The fixed support element may comprise a tube fixed to the leveller, which may comprise a box leveller in a preferred embodiment.

The laser device may comprise a laser sensor.

According to a further aspect of the invention there may be provided a system, including apparatus as hereinbefore defined.

Apparatus for monitoring the depth of a layer of filter media in a slow sand filter is hereinafter described, by way of example, with reference to the accompanying drawings.

Figure 1:
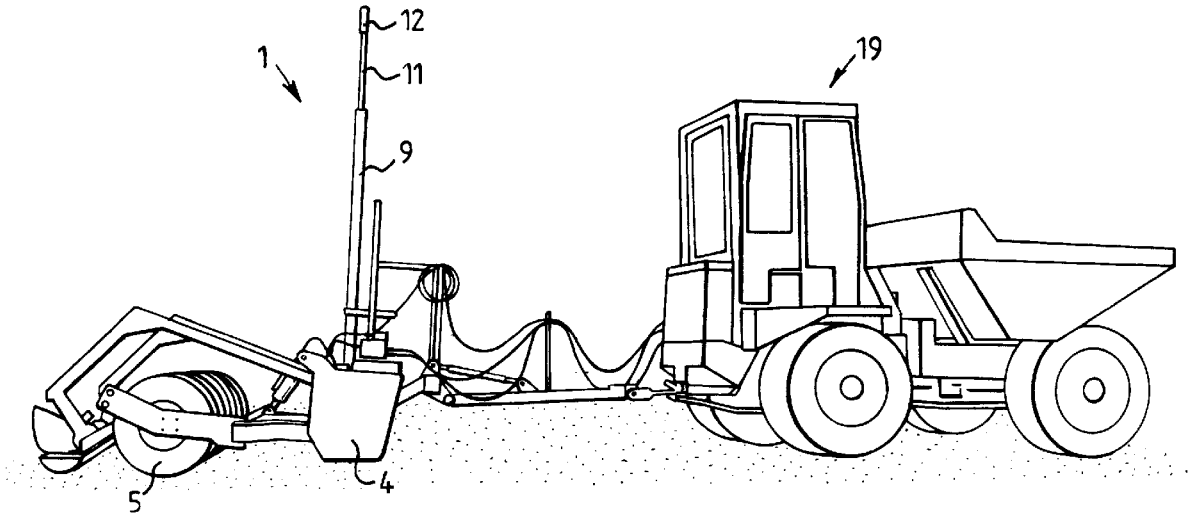
FIG. 1 is a schematic view of apparatus according to the invention being towed by a tractor unit.

Referring to the drawings, there is shown apparatus 1 for monitoring the depth of a layer 2 of a filter media such as sand in a filter such as a slow sand filter 3, comprising a leveller 4, in the embodiment a box leveller with a trailing smoothing device, wheel or roller 5, adapted to level the surface of the layer 2 of sand and a laser device 6 mounted on a mount 7 which is movable substantially vertically and has a calibration means in the form of a visual calibration scale whereby to determine depth of filter media.

The laser device 6 comprises a support element 9 in the form of a tube which is fixed to the box leveller 4, in a vertical plane at or near a cutting edge 10 of the leveller, there being a manually operable telescopic member or mast, which comprises the mount 7 and carries the visual calibration scale 8 and which mast 7 is telescopically mounted in the tube 9.

The top edge 11 of the tube 9 provides the datum or reading point for reading off a measurement on the calibration scale 8. The mast 7 carries at its top (as viewed) a laser sensor 12 forming the laser device which is aligned with a laser transmitter 13 which is mounted at the side 14 of the slow sand filter 3 on a tripod 15. The tripod 15 has a telescoping facility too, provided by a handle and crank arrangement (not shown) whereby the laser transmitter 13 can be raised or lowered until it is at a desired datum level 16. Stated in another way, the vertical adjustment gives the required height 'Y' in FIG. 2.

Figure 2:
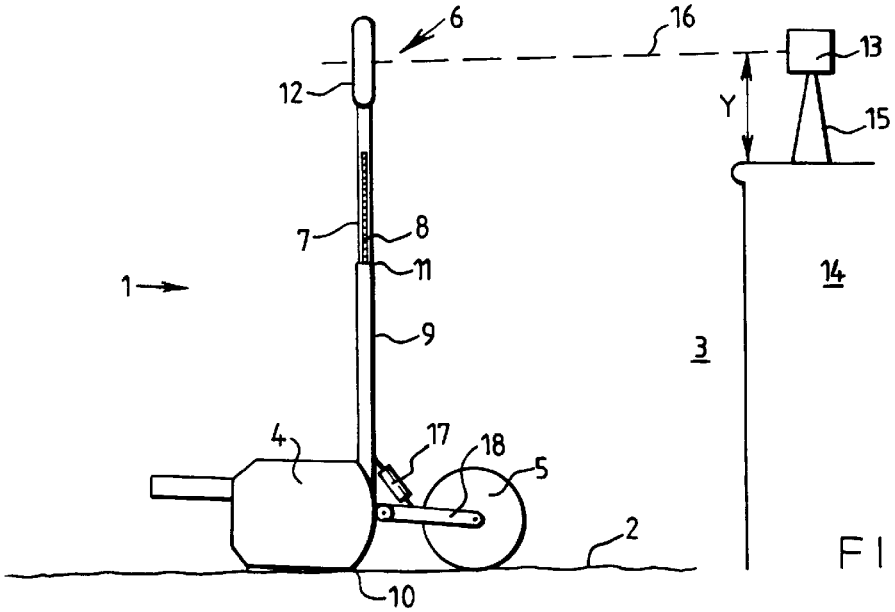
FIG. 2 is a schematic drawing to an enlarged scale showing the apparatus of FIG. 1 incorporated in a levelling system.

The graduation (not shown) on the graduated or calibrated scale 8 increase away from a zero mark of the scale, in both an upward and a downward direction as viewed, FIG. 2. Thus the graduations increase in two directions along the length of the scale.

The setting of the scale 8 at "zero", that is with the zero mark at the top edge of the tube 9, provides that the cutting edge 10 of the box leveller 4 is targeted on the upper surface of the granulated activated carbon (GAC).

It will be understood that the apparatus 1 can be used in a slow sand filter which includes a "sandwich" of granulated actuated carbon (GAC) between two layers of filter medium such as sand. The leveller 4 is used to remove a layer of sand 2 to a desired depth, this being continuously achieved in the embodiment by an actuator element in the form of a hydraulic ram element 17 which is pivotably connected between the tube 9 and a yoke or frame 18 which supports the smoothing device, wheel or roller 5. The hydraulic fluid to the ram element 17 is provided by hydraulic fluid of a tractor or dumper 19 which draws the leveller 4. Control is provided by control means such as a computer which responds to a signal from the laser monitor 12 to adjust extension of a ram of the hydraulic element 17 so that the height (level) of the cutting edge 10 is virtually instantaneously adjusted. Thus the cutting edge 10 is being moved up and down continuously with respect to the wheel 5 and the rear of the leveller 4. This is achieved by the laser receiver 12 monitoring the transmitted beam 16 and adjusting the height to the required level which controls this on-board computer for the ram element. There is thus a closed-loop feedback system for monitoring, and controlling, the position of the cutting edge 10, and hence the depth of cut is monitored.

In order to set up the mast 7 for levelling the sand surface below the GAC before the GAC is laid, the mast 7 is set at a reading below zero. The magnitude of this reading equates to the depth of compacted GAC envisaged. All readings above zero are a direct representation of the depth of sand remaining above the GAC, i.e. that is the depth of "buffer" sand left in the bed can be determined after each grading operation. Where bed depths vary, the setting for the laser beam height, "y" would vary bed to bed.

Most GAC/sand sandwich beds have "Bed No" signs adjacent to them. To aid the setting up of laser transmitters, dimension "y" could be added to each sign, for each bed.

Figure 3:
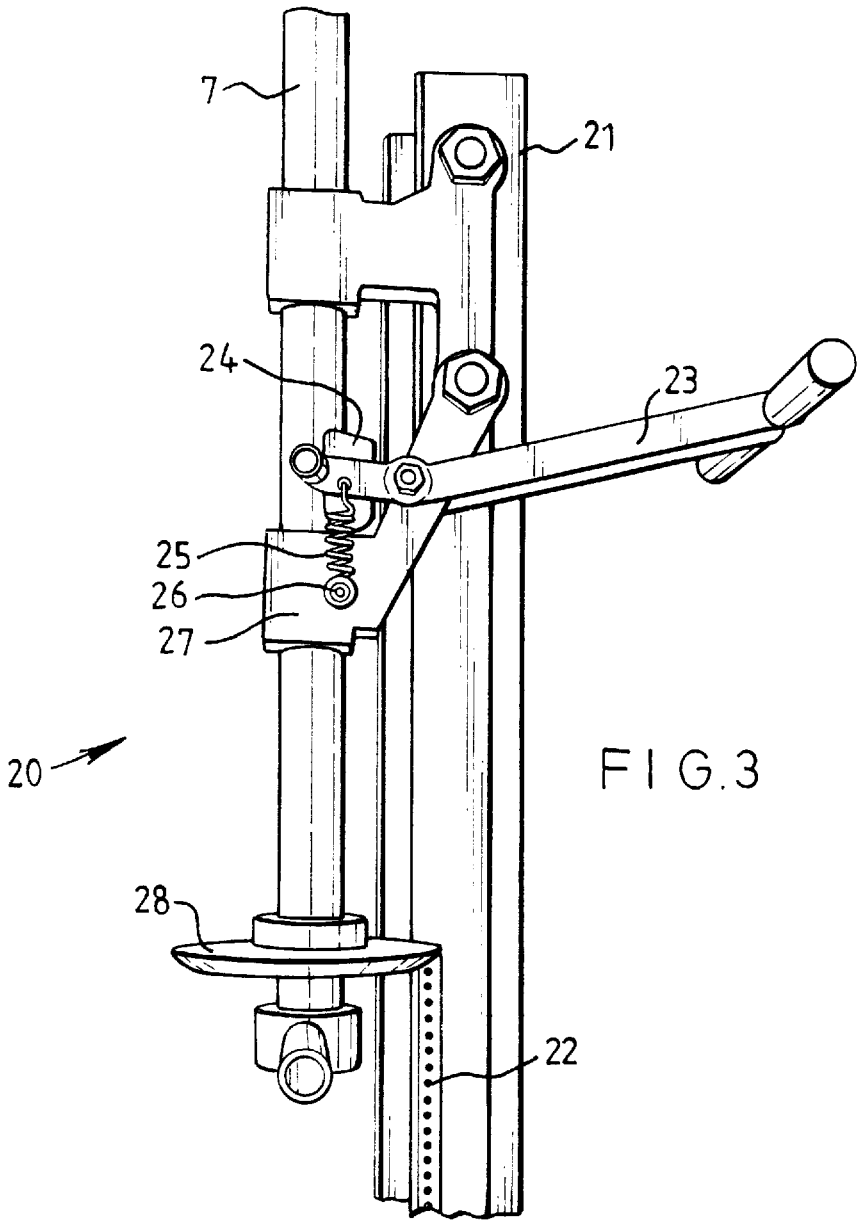
FIG. 3 is a drawing of part of a further embodiment of apparatus according to the invention.

Referring to FIG. 3, there is shown a mechanism 20 for securing the mast 7 at a desired height during setting. The mechanism 2 comprises a handle pivoted to a post 21 carrying a height calibration scale 22. The handle, which is a double handle carries an abutment 24 which is mounted under the bias of a spring 25. When the handle 23 rotated clockwise, it removes the abutment away from the mast to an over-centre position of the spring, pivoted at 26 to a mount 27 so that the mast can be adjusted in height. Moving the handle 23 counter-clockwise ensures that the spring 25 moves the abutment 24 back into locking engagement with the mast. There is a calibration device in the form of a disc 28 which is aligned with a desired depth as shown on the scale, and can be read from all sides.

In addition to providing a relatively simple means for determining media i.e. sand depth, all embodiments of the apparatus 1 can assist in the use of a box leveller 4, i.e. by subtracting the estimated "current depth of skim" from the bed's previous mast reading, the laser mast 7 can be quickly adjusted close to the optimum position (at present time is spent "searching" for this).

It will be understood that modifications are possible. Thus a motorized telescopic laser mast/computer technology could be used.

A rack and pinion jack could facilitate relatively easy raising and lowering of the mast over the range of media depths envisaged.

Permanent stanchions within normal usage can be provided on the side of the filter for the mounting of a laser transmitter for the box levellers. This would obviate the need for setting-up individual laser transmitters for dimension "Y".

Regular use will allow the box leveller to grade rapidly a skimmed bed to with + or − 15mm (say) in a relatively short time.

Using the apparatus based on a box leveller with an uprated smoothing device or roller could eliminate need for manual surveying and could obviate the need for a second smoothing operation (necessary to remove the "surveyor's" footprints etc.)

I claim:

1. Apparatus for monitoring the depth of a layer of filter media in a slow sand filter, comprising:

(i) a leveller adapted to level the surface of said layer;

(ii) a mount which is movable substantially vertically, said mount has a telescopic member; and (iii) a laser device including a laser transmitter and a laser sensor, said laser sensor being mounted on said mount, said laser sensor having calibration means for determining the depth of said filter media, wherein said calibration means has a scale on the elongate member forming part of said telescopic member and being reciprocable in a tubular member of said telescopic member, said tubular member coupled to said leveller, wherein an upper edge of said tubular member provides a datum for reading off a measurement on said scale.

2. Apparatus as defined in claim 1 wherein said calibration means increases from a zero in two directions along the length of said elongate member.

3. Apparatus as defined in claim 2, wherein said elongate member comprises a telescopic member.

4. Apparatus as defined in claim 2, wherein said elongate member is carried by said tubular member.

5. Apparatus as defined in claim 4, wherein said tubular member comprises a tube fixed to said leveller.

6. Apparatus as defined in claim 4, wherein there is an actuator element connected between said tubular element and a trailing part of said leveller whereby to adjust the height of said leveller.

7. Apparatus as defined in claim 6, wherein said actuator element is an hydraulic ram element.

8. Apparatus as defined in claim 1, wherein said leveller comprises a box leveller.

9. A system, including apparatus as defined in claim 1, and said laser transmitter.

10. A system as defined in claim 9, wherein said laser transmitter is adjustable in height.

* * * * *